United States Patent [19]

Redien

[11] Patent Number: 4,553,367

[45] Date of Patent: Nov. 19, 1985

[54] FRAME FOR A DOOR OR WINDOW WITH AT LEAST ONE BRACE MANUFACTURED FROM HOLLOW, PREFERABLY HEAT-INSULATED COMPOSITE SECTIONS

[75] Inventor: Jean-Paul Redien, Hiddenhausen, Fed. Rep. of Germany

[73] Assignee: Schuco Heinz Schurmann GmbH & Co, Bielefeld, Fed. Rep. of Germany

[21] Appl. No.: 569,018

[22] Filed: Jan. 9, 1984

[30] Foreign Application Priority Data

Jan. 22, 1983 [DE] Fed. Rep. of Germany ..... 3302162

[51] Int. Cl.[4] ..... E04C 2/38

[52] U.S. Cl. ..... 52/656; 52/721

[58] Field of Search ..... 52/657, 656, 393, 399, 52/402, 721; 403/199, 187

[56] References Cited

FOREIGN PATENT DOCUMENTS 2052003 1/1981 United Kingdom ..... 403/187

*Primary Examiner*—Carl D. Friedman

*Assistant Examiner*—Naoko N. Slack

*Attorney, Agent, or Firm*—Sprung Horn Kramer & Woods

[57] ABSTRACT

A frame for a door or window with at least one brace, manufactured from hollow, preferably heat-insulated composite sections. A filler is positioned at the butt joint between a frame section and a brace section. The filler matches the contours of a groove in the frame section. The filler extends into the brace section. The filler has an intermediate filler slot that extends parallel to the axis of the brace section. The filler also has a filler bore that extends parallel to the axis of the frame section and empties into the filler slot. Putty is forced into the filler bore and slot to seal off the butt joint from the front of the frame.

4 Claims, 9 Drawing Figures

FRAME FOR A DOOR OR WINDOW WITH AT LEAST ONE BRACE MANUFACTURED FROM HOLLOW, PREFERABLY HEAT-INSULATED COMPOSITE SECTIONS

BACKGROUND OF THE INVENTION

The present invention relates to a frame for a door or window with at least one brace, manufactured from hollow, preferably heat-insulated composite sections.

Puttying the butt joint between a frame section and a brace section in the manufacture of frames for doors or windows of this generic type has always been extraordinarily difficult because the putty, which is the only material that can be employed, is introduced into the butt joint in large quantities and and can not be controlled.

SUMMARY OF THE INVENTION

The main object of the present invention is to provide a frame for a door or window of the same generic type and consisting of the simplest of means that allows the butt joint between the frame section and the brace section to be puttied unexceptionably and subject to control with little putty.

This object is achieved in accordance with the present invention by means of filler that is positioned at the butt joint between the frame section and the brace section, that matches the contours of a groove in the frame section, that extends into the brace section, and that has, first, an intermediate filler slot extending parallel to the axis of the brace section and, second, a filler bore extending parallel to the axis of the frame section and emptying into the filler slot, wherein putty is forced into the filler bore and slot to seal off the butt joint from the front of the frame.

The utilization of a special filler in conjunction with a slot and a bore is an extremely simple means of ensuring that the butt joint is unexceptionably sealed with relatively little putty.

Since the filler fits the groove in the frame section, a major part of the groove is filled up even before the putty is applied. The small area remaining can be sealed as intended by forcing putty into the filler bore and slot without special care or skill on the part of the assembler.

When the sections are composite sections, the filler can preferably be positioned in an inner space facing the front of the brace section.

When the sections have only one inner space, the filler can preferably be positioned in the area facing the front of the frame and rest at the rear against a T connection that extends into the remaining part of the space inside the brace section.

The filler also preferably be inserted positively into a groove in the frame section and the filler can be made out of plastic.

Some preferred embodiments of the invention will now be described with reference to the attached drawings, wherein:

DETAILED DESCRIPTION OF THE PREFERRED EMBODIMENTS

Figure 1:
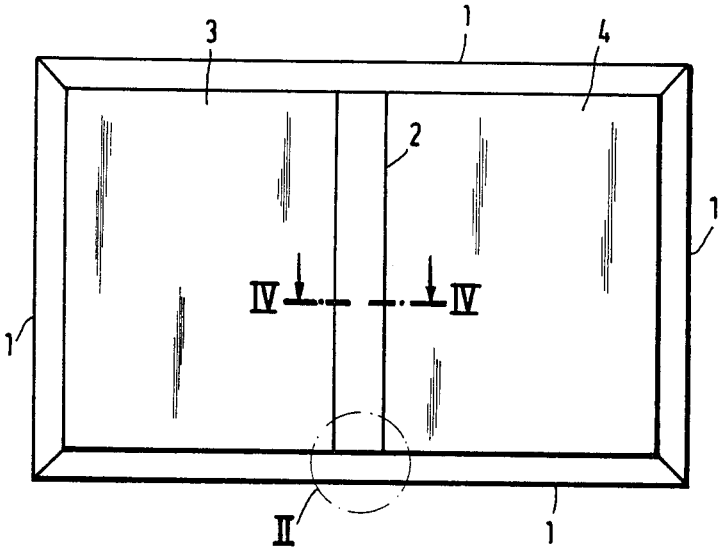
FIG. 1 is a front view of a window frame with a brace manufactured from hollow sections according to the invention.

The window frame illustrated in FIG. 1 consists of four outer frame sections 1 and a brace section 2 that divides the finished frame into two framed areas 3 and 4 Brace section 2 is butt-jointed to frame sections 1.

Figure 2:
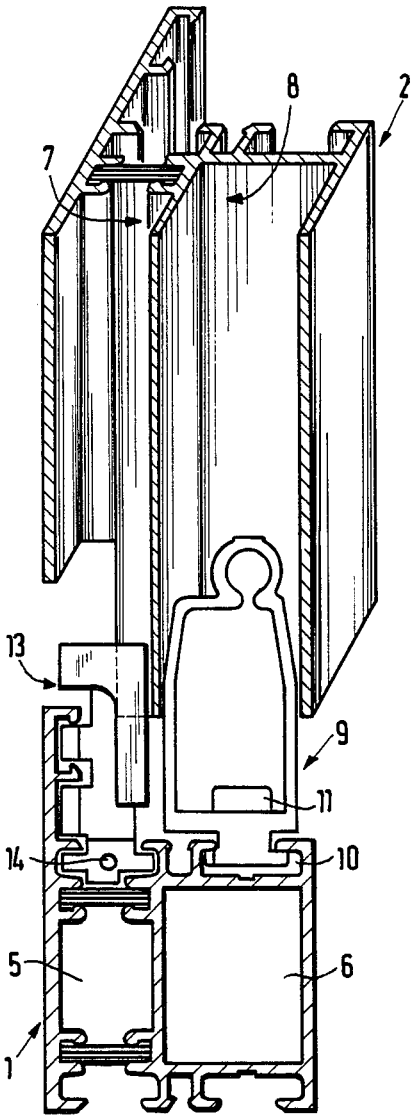
FIG. 2 is a section though area II of the frame and brace in FIG. 1.

FIG. 2 is a detail of the area around the joint and showing frame section 1 and brace section 2 as both being composite heat-insulated sections.

Frame section 1 has two inner spaces 5 and 6 and brace section 2 two inner spaces 7 and 8.

The inner spaces 5 and 7 of sections 1 and 2 respectively are toward the front of the finished frame and inner spaces 6 and 8 toward the rear.

A "T" connection 9, in itself known, is positively secured within a longitudinal groove 10 on frame section 1 and extends into the rear inner space 8 of brace section 2. "T" connection 9 is secured against longitudinal displacement in groove 10 by a threaded bolt 11.

There is a filler 13 toward the front of the frame in the vicinity of the butt joint. Filler 13 matches the contours of the groove in frame section 1 toward the front and is inserted into the groove.

Filler 13 also extends into the inner space 7 toward the front of brace section 2.

As illustrated in FIGS. 6 through 9 in particular, filler 13 has a filler bore 14 that extends, as will be especially evident from FIG. 2, parallel to the axis of frame section 1. Filler bore 14 opens into a filler slot 15 that extends parallel to the axis of brace section 2.

Putty is forced through filler bore 14 and filler slot 15, which opens toward the front of the frame. Since the empty space is relatively small and because the insertion of putty through the bore and slot can be controlled precisely, the putty will securely seal off the total vicinity of the butt joint between frame section 1 and brace section 2. Comparatively little putty is required because filler 13 itself takes up most of the empty space at the joint.

Figure 3:
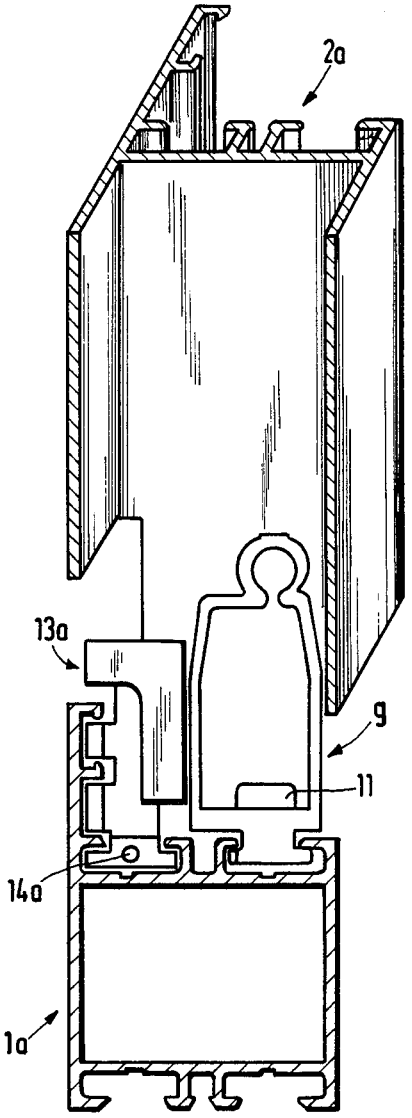
FIG. 3 is a section similar to that in FIG. 2 of another embodiment according to the present invention.
Figure 4:
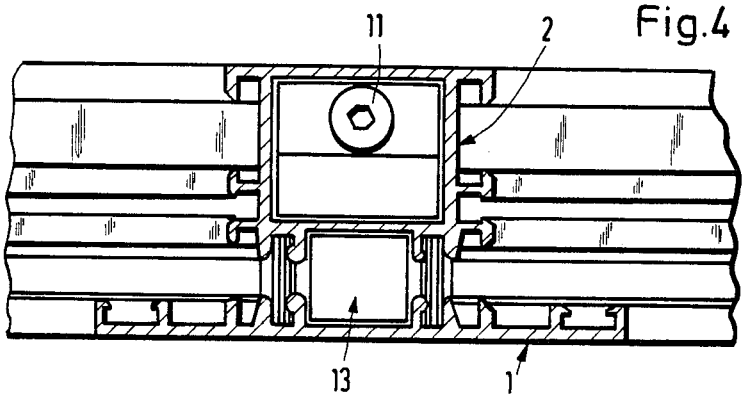
FIG. 4 is a a section along the line IV—IV in FIG. 1.
Figure 5:
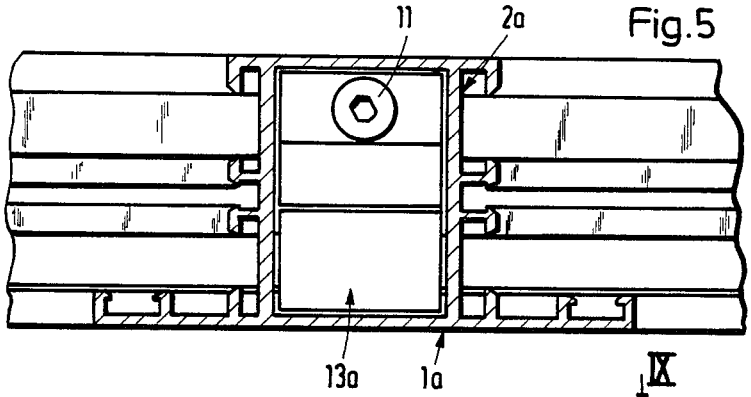
FIG. 5 is a section similar to that in FIG. 4 through the embodiment illustrated in FIG. 3.
Figure 6:
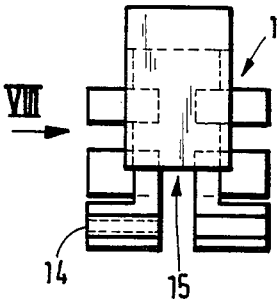
FIG. 6 is a rear view of the filler inserted at the butt joint between the frame and brace sections of the embodiment illustrated in FIG. 4.
Figure 7:
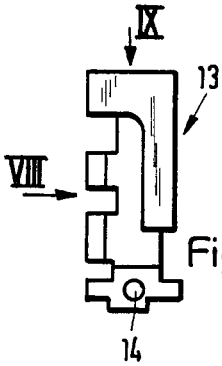
FIG. 7 is a view in the direction indicated by arrow VII in FIG. 6.
Figure 8:
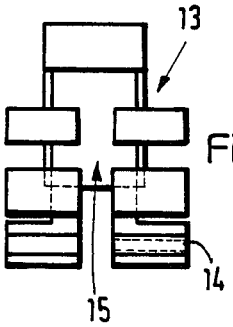
FIG. 8 is a view in the direction indicated by arrow VIII in FIG. 7.
Figure 9:
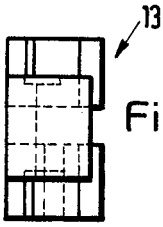
FIG. 9 is a view in the direction indicated by arrow IX in FIG. 7.

The frame section 1*a* and brace section 2*a* in the embodiment illustrated in FIGS. 3 and 5 each have only one inner space. These sections are not heat-insulated.

Frame section 1*a* and brace section 2*a* are also connected by a "T" connection 9, which does not, however, completely fill the whole inner space of brace section 2*a*.

The area of the inner space in brace section 2*a* that is not occupied by "T" connection 9 is taken up, at least in the vicinity of the butt joint, by a filler 13*a* with bore 14*a* similar to that illustrated in FIG. 2. The shape and size of the plan view of filler 13*a* are such that it completely fills the front of the space inside brace section 2*a* and rests against T connection 9 at the rear.

It will be appreciated that the instant specification and claims are set forth by way of illustration and not limitation, and that various modifications and changes may be made without departing from the spirit and scope of the present invention.

What is claimed is:

1. In a frame for a door or window having frame sections, at least one brace, wherein the frame sections and brace comprise hollow sections with channels therein and a T connector connecting one end of the brace and an intermediate portion of a frame section together at a butt joint, the improvement wherein: each frame section has two parallel longitudinally extending channels and the brace has an inner space therein, with the T connector engaging one channel of the frame section and extending into the inner space of the brace without filling same; a filler member positioned at the butt joint and having a first portion that matches the contours of and is slidably received in the other channel in the frame section and a second portion slidably received in the inner space of the brace section, wherein the first portion of the filler member has a bore therein extending parallel to the other channel and receptive of a sealant when the frame section and brace are connected and the second portion includes a slot perpendicular to the bore and in communication therewith, whereby sealant forced into the bore flows into the slot and seals off the butt joint.

2. The frame as in claim 1, wherein the frame has a front face and the second portion of the filling means is positioned in the inner space facing the front face of the frame and wherein the T connector and filler member fill the inner space in the vicinity of the butt joint.

3. The frame as in claim 1, wherein the brace has two parallel inner spaces filled in the vicinity of the butt joint by filler member and T connector.

4. The frame as in claim 1, wherein the filler member comprises a unitary member composed of plastic material.

* * * * *